US007827651B2

(12) United States Patent
Graham et al.

(10) Patent No.: US 7,827,651 B2
(45) Date of Patent: Nov. 9, 2010

(54) QUICK RELEASE PAINT ROLLER

(75) Inventors: Nicholas Simon Graham, Potomac, MD (US); Michael James Marchese, III, Lincroft, NJ (US); Michael Patrick Duffy, Bloomington, MN (US); Edward Reynolds, Redding, CT (US)

(73) Assignee: Zibra, LLC, Mooresville, NC (US)

( * ) Notice: Subject to any disclaimer, the term of this patent is extended or adjusted under 35 U.S.C. 154(b) by 855 days.

(21) Appl. No.: 11/800,747

(22) Filed: May 7, 2007

(65) Prior Publication Data

US 2008/0276400 A1 Nov. 13, 2008

(51) Int. Cl.
*B05C 17/02* (2006.01)

(52) U.S. Cl. ..... 15/230.11; 492/13; 492/19

(58) Field of Classification Search ..... 15/230.11; 492/13, 19; *B05C 17/02*
See application file for complete search history.

(56) References Cited

U.S. PATENT DOCUMENTS 2,811,733 A * 11/1957 Sloan ..... 15/230.11
3,060,555 A 10/1962 Kirshenbaum et al.
3,906,581 A 9/1975 Marino et al.
5,509,165 A * 4/1996 Zigelboim et al. ..... 15/230.11
5,921,905 A * 7/1999 Newman et al. ..... 492/13
6,519,800 B2 2/2003 Newman et al.
6,681,438 B2 1/2004 Newman et al.
6,941,609 B2 9/2005 Woodruff et al.
2002/0187888 A1 * 12/2002 Newman et al. ..... 492/13
2006/0130261 A1 6/2006 Futo et al.
2006/0130262 A1 6/2006 Visk et al.

FOREIGN PATENT DOCUMENTS

DE 196 08941 A1 9/1997

* cited by examiner

*Primary Examiner*—Monica S Carter
*Assistant Examiner*—Stephanie Newton
(74) *Attorney, Agent, or Firm*—Wegman, Hessler & Vanderburg

(57) ABSTRACT

A quick-release paint roller having a roller cover that can be removed from a handle assembly without requiring the user to apply a force directly to the roller cover. The paint roller includes a tube-shaped roller cover having an outer surface of paint absorbing material and a rotatably mounted roller core. When the actuator is in the release position, the roller mounting device is free of the latching mechanism, thus permitting the roller core and roller cover to be removed from the handle assembly.

18 Claims, 5 Drawing Sheets

QUICK RELEASE PAINT ROLLER

BACKGROUND OF THE INVENTION

1. Field of Invention

This invention relates to a roller assembly for use in applying a coating to a surface, and more particularly, to a paint roller assembly.

2. Description of Related Art

It is known to use paint roller assemblies having a handle with a roller support and a rotatable roller cover to apply paint to a wall. Normally, the roller cover is removably mounted on the roller support so that the roller cover can be detached from the support after use and cleaned or replaced as desired. Additionally, the useful life of the roller cover is often quite limited when compared to that of the handle and roller support. As such, the roller cover is usually removed from the handle after each use.

Typically, roller covers are frictionally secured to the roller support. One disadvantage associated with this type of roller assembly is that in order to remove the roller cover from the roller support, it is usually necessary to grasp the outer surface of the roller cover and slide it off of the roller support. As the roller cover being removed is normally covered with wet paint, the process of removing the roller cover from the roller assembly can be messy and often leads to paint getting on the hands and clothes of the person removing the roller cover. If one waits until the paint on the roller cover dries before removing the cover, the paint between the roller cover and the roller support dries and seals the roller cover to the roller support. Thus, in order to remove the roller cover from the paint roller assembly it is sometimes necessary to break the dried paint away from the end caps of the roller support, thereby allowing the roller cover to be removed from the roller assembly. Alternatively, it may be necessary to slice, or cut the roller cover along a length thereof, allowing the roller cover to be peeled away from the roller assembly.

Based on the foregoing, it would be desirable to provide a paint roller assembly with a roller cover that can be removed quickly and easily without having to grasp or touch the paint-covered roller cover.

SUMMARY OF INVENTIVE FEATURES

One aspect of the invention is directed to a quick-release paint roller that permits a roller cover to be removed from the handle assembly without requiring the user to apply a force directly to the roller cover. The paint roller includes a Y-shaped roller frame that receives a tube-shaped roller cover. The roller frame has first and second arms, with the first arm having a quick-release capture mechanism with a hinged extension that pivots between a roller-capture position in which the roller cover is rotatably mounted on the roller frame between the first and second arms and a roller-release position in which the roller cover is decoupled from the roller frame such that decoupling of the paint roller cover from the roller frame occurs without requiring a user to apply a manual force directly to the roller cover.

In one embodiment, the capture mechanism includes a pivoting body and a roller cover mounting cone that is rotatably mounted on the hinged body and is received by the tube-shaped roller cover. At least one torsion spring interacts with a lower branch of the first arm and the pivoting body of the hinged extension such that the at least one torsion spring biases the hinged extension from its roller-capture position to its roller-release position. A detention pin is received by the pivoting body so as to maintain the pivoting body, against the bias force of the torsion spring, in the roller-capture position and a detention pin spring normally biases the detention pin into pivoting body. A roller-release button on the roller frame actuates the detention pin so as to control movement of the capture mechanism between the roller-capture position to the roller-release position.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
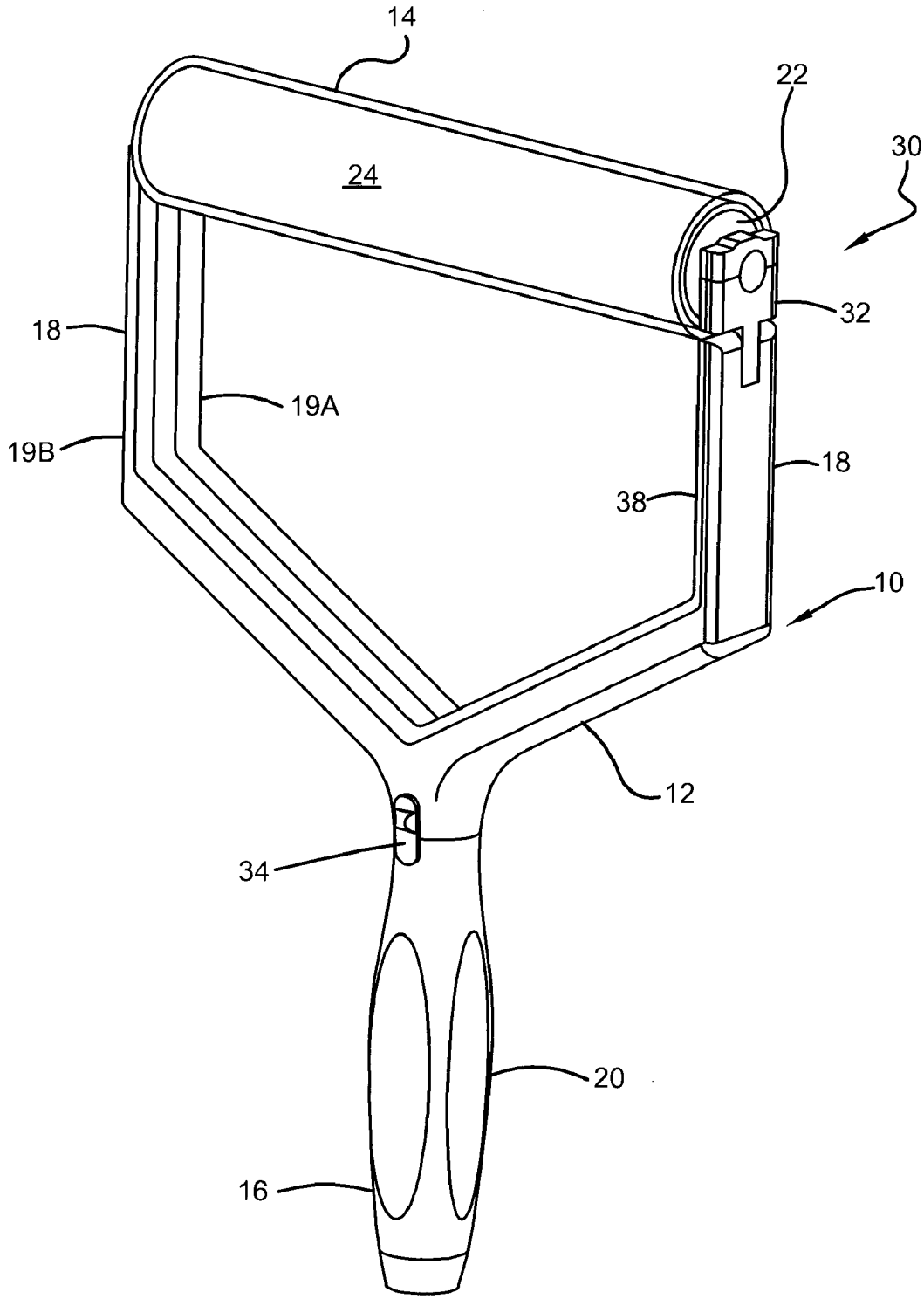
FIG. 1 is a perspective view of a paint roller.

Referring now to FIG. 1, the invention is directed to a roller tool assembly generally designated by the reference number 10 for use in applying paint or other product to a work surface. The paint roller 10 includes a frame 12 and a roller cover 14 rotatably coupled thereto. The frame 12 has a hand grip 16 useful for griping the paint roller 10 and a pair of spaced apart arms 18 for rotatably receiving the ends of the roller cover 14 such that the frame 12 has a generally Y-shape. By generally Y-shaped it is meant that the frame 12 has a hand grip 16 and two spaced apart arms 18 that capture the ends of the roller cover 14 and one skilled in the art will understand that this is not to be construed narrowly as a single specific shape. Thus, it is conceived that the actual shape of the arms 18 and hand grip 16 may also have a somewhat h-shape or even T-shape. In one embodiment, the hand grip 16 has a soft ergonomic grip overmold 20 to improve comfort while in use. Alternatively, other hand grips known in the art may be used without departing from the scope of the invention. Desirably, a telescoping handle (not shown) slides out of or can be attached to the hand grip 16 to add to the handle length for hard to reach areas. While materials for the frame 12 are not intended to be limiting, preferably the frame 12 is manufactured of a material such as aluminum or stainless tubing, fiberglass, or a synthetic polymeric material, such as nylon, polyethylene or other molded plastic for providing a light weight yet durable paint roller 10. In the illustrated embodiment, the frame 12 is formed from two half shells 19A and 19B that are joined together by any known means such as by welding, adhesive, fasteners, etc.

The roller cover 14 is desirably a standard 9-inch (23 cm) roller cover that is commonly used with conventional paint rollers that has an inner tube 22 having a 1.5-inch (3.8 cm) inside diameter and an outer circumferential surface material 24 for carrying paint or other material to be applied to the work surface. As is known, the surface material 24 is made of sponge, cotton, synthetic fibers, wool or the like and is highly capable of absorbing the paint or other liquid to be applied. However, the frame 12 may be sized so as to receive roller covers 14 with other widths, such as 3 inches, 6 inches, 7 inches 12 inches or 18 inches, and other diameters without departing from the scope of the invention.

According to the invention, the paint roller 10 has a "hands-free" quick-release capture mechanism 30 that quickly detaches the roller cover 14 from the frame 12. In the illustrated embodiment, the capture mechanism 30 comprises a hinged extension 32 (best seen in the enlarged view of FIG. 2) at the distal end of one of the arms 18 and a roller-release button 34, which, when actuated, causes the hinged portion 32 of the arm 18 to pivot outwardly to automatically release the roller cover 14 and thereby at least partially decouple the roller cover 14 from the frame 12. Actuation of this quick-release capture mechanism 30 automatically releases roller cover 14 from the frame 12 thus eliminating the need for the user to handle the paint-saturated roller cover 14 when removing the roller cover 14 from the frame 12. The terms "automatic", "hands-free" and "quick-release" as used herein with respect to the capture mechanism 30 mean that the decoupling of the paint roller cover 14 from the frame 12 occurs without requiring the user to apply a manual force directly to the paint roller cover 14. In other words, although a force is required to be applied to the capture mechanism 30 to initiate the decoupling process, the actual force decoupling the roller cover 14 from the frame 12 is provided by means other than manual force applied by the user to the roller cover 14, as will be set forth more fully below.

Figure 3:
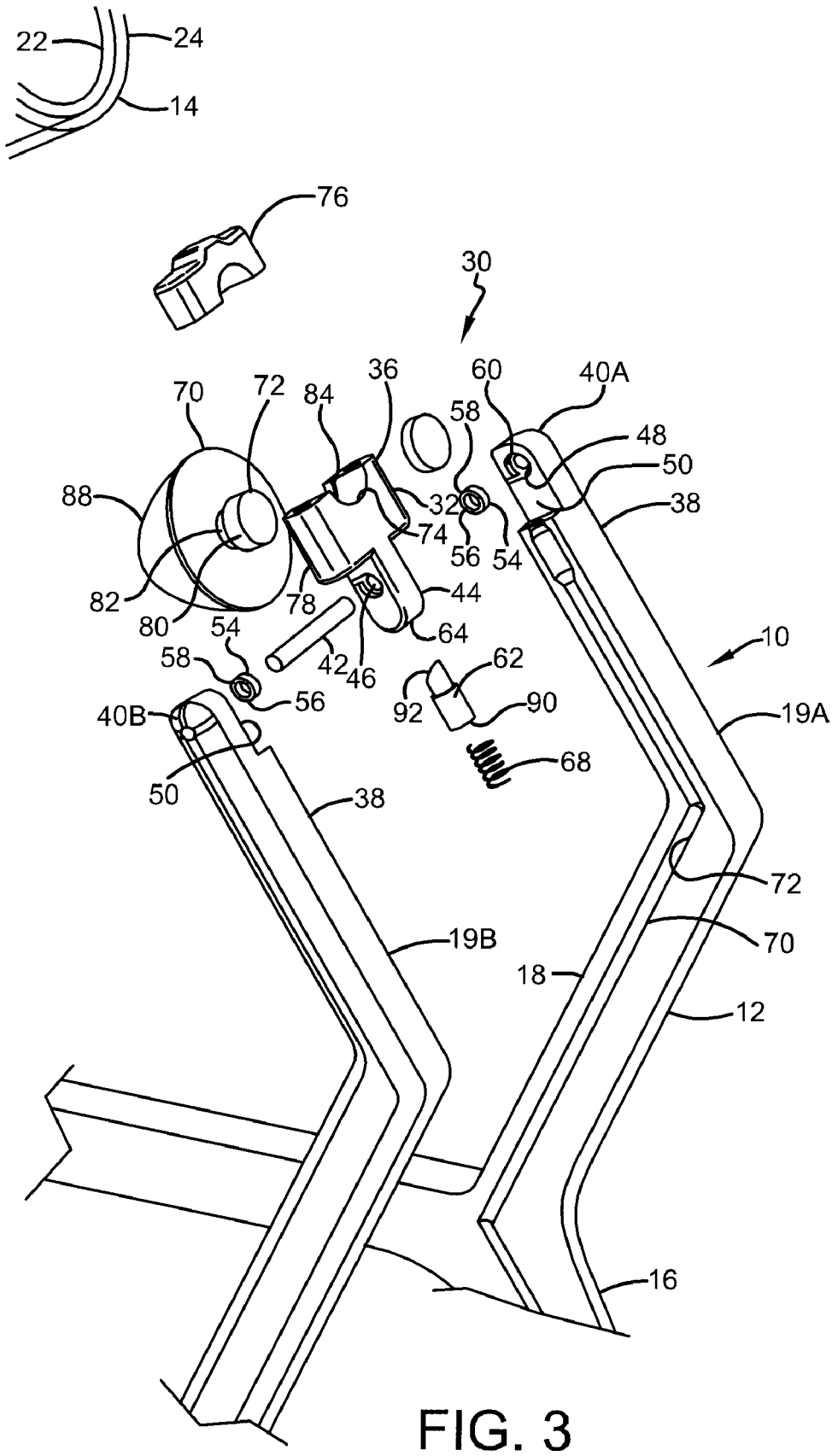
FIG. 3 is an exploded view of the paint roller of FIG. 1.

Turning now to FIG. 3, the hinged extension 32 has a pivoting body 36 at the extremity of the arm 18 that is movably attached, preferably by a pivoting action, with a lower branch 38 of the arm 18. In one embodiment, the lower branch 38 of the arm 18 has forked ends 40A and 40B that supports a shaft 42 or similar pin member 42. The pivoting body 36 has a tongue portion 44 that mates with the forked ends 40A, 40B of the arm 18. The shaft 42 passes through the tongue portion 44 and forms an axis about which the hinged extension 32 pivots with respect to the arm 18 of the frame 12. In the illustrated embodiment, a single shaft 42 is inserted through a hole 46 in the tongue portion 44 and the ends of the shaft 42 are received in cavities 48 molded or otherwise formed in inner surfaces 50 of the forked ends 40A, 40B of the arm 18 to attach the hinged extension 32 to the arm 18. Desirably, the shaft 42 is prevented from rotating in the cavities 48 such as with tooth and groove combination (not shown) between the shaft 42 and the arm and/or pivoting body 36. However, one skilled in the art will understand that the hinged extension 32 may be attached to the arm 18 in other suitable ways. For example, the pivoting body 36 of the hinged extension 32 may have the forked end and the lower branch 38 of the arm may have the tongue portion. Alternately, a pair of stub shafts (not shown) may extend from the forked end 40A, 40B of the arm 18 and can be received in openings on either side of the tongue portion 44. Broadly, the hinged extension 32 may be attached to the lower branch 38 of the arm 18 with any suitable pivoting joint using sound engineering judgment.

Figure 2:
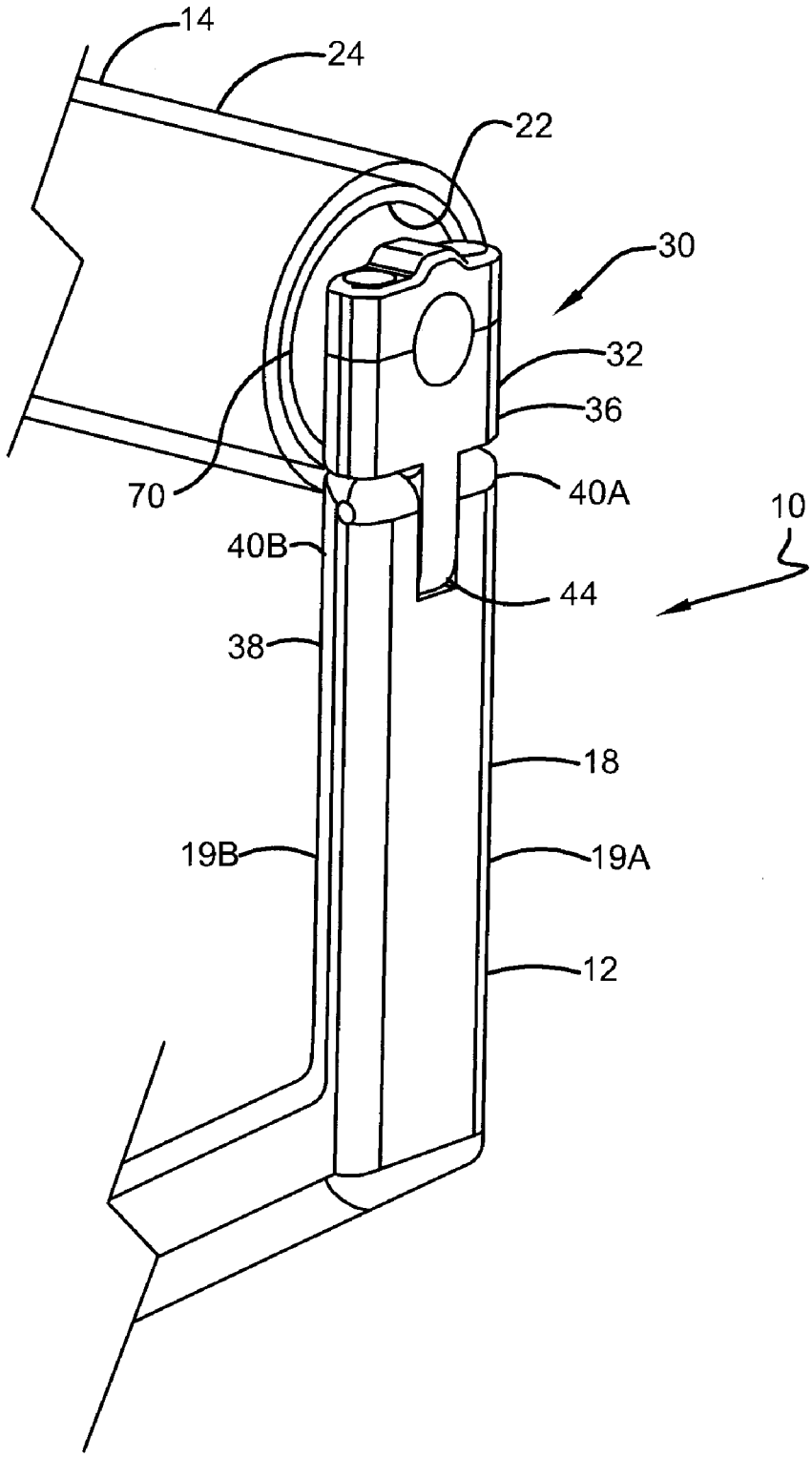
FIG. 2 is an enlarged perspective view of a portion of the paint roller of FIG. 1 illustrating a hinged extension of an arm of the roller frame that provides a quick-release feature.

At least one torsion spring 54 is mounted on the shaft 42 with a first leg 56 that interacts with the lower branch 38 of the arm 18 and a second leg 58 that interacts with the pivoting body 36 of the hinged extension 32. In the illustrated embodiment there are two torsion springs 54, one on either side of the tongue portion 44 and the springs 54 are received in outer cavities 60 molded or formed in the inner surfaces 50 of the forked ends 40A, 40B of the lower branch 38. The springs 54 bias the hinged extension 32 from a roller-capture position (as illustrated in FIG. 2) to a roller-release position such that the hinged extension 32 is pivoted outward so that the pivoting body 36 forms an angle, such as between 45 and 135 degrees, and more desirably about 90 degrees, with the lower branch 38 of the arm 18.

Figure 4:
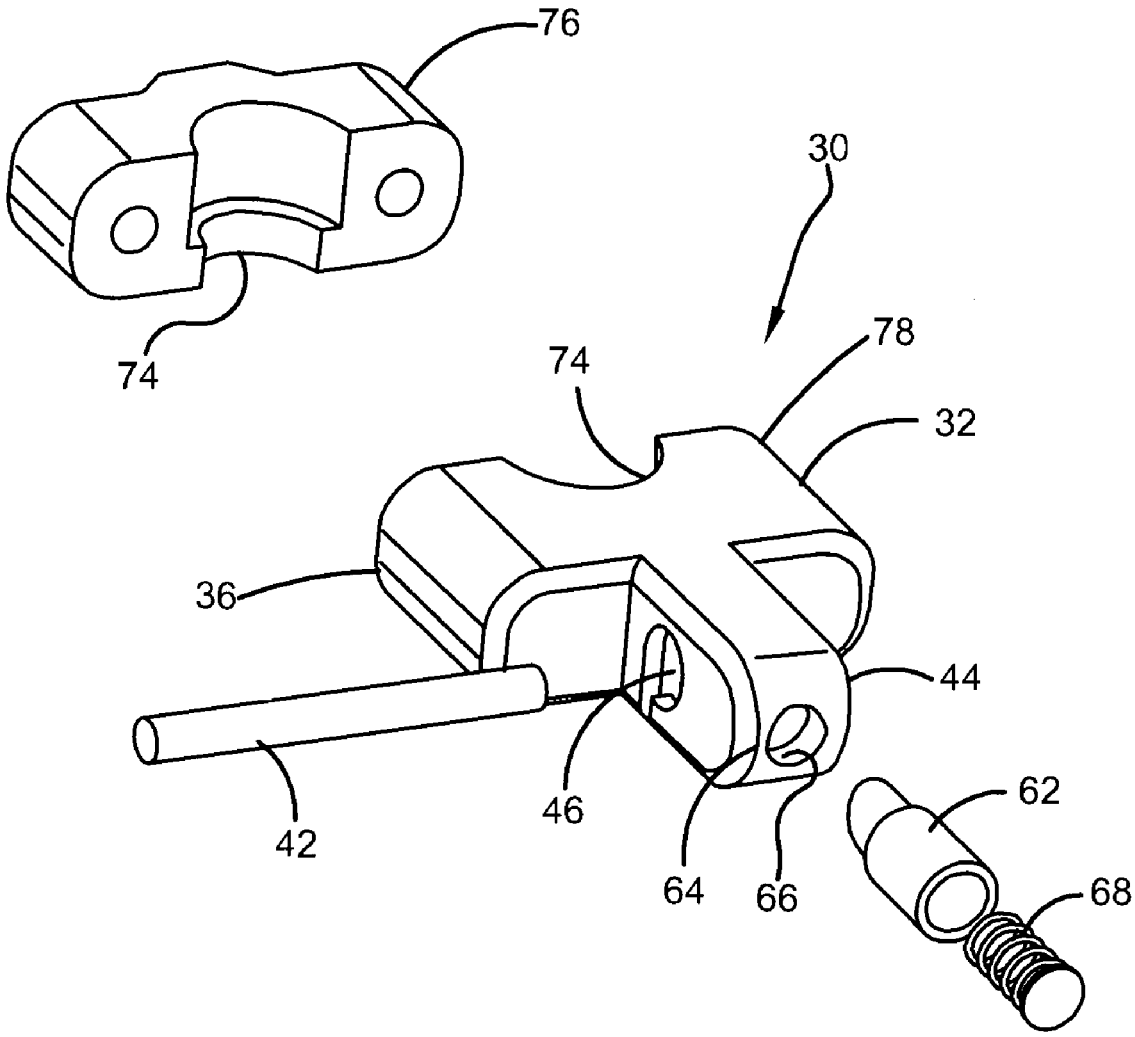
FIG. 4 an exploded perspective view of a portion of the hinged extension of the roller assembly of FIG. 2.

A detention pin 62 is configured to be received by the tongue portion 44 so as to maintain the pivoting body 36, against the bias force of the torsion springs 54, in the roller-capture position. As seen in FIG. 4, a tip 64 of the tongue portion 44 has an opening 66 that receives the detention pin 62. A detention pin spring 68 normally biases the detention pin 62 into the opening 66 in the tongue portion 44. The position of the detention pin 62 is controlled by the roller release button 34 (shown in FIG. 1) in the form of a slide switch for actuating the quick-release feature 30. The roller release button 34 is connected to the detention pin 62 with a cable 70 routed through a channel 72 formed in the frame 12 such that actuation of the roller release button 34 causes the detention pin 62 to be withdrawn from the opening 66 in the tongue portion 44 against the force of the spring 68 to allow the hinged extension 32 to pivot and release the roller cover 14. The roller release button 34 is desirably positioned in the frame 12 at a location remote from the hinged extension 32, such as in the hand grip 16. The roller release button 34 is shown as a slide switch that moves the detention pin 62, however, one skilled in the art will understand that other mechanisms for actuating the detention pin 62 may be used using sound engineering judgment without departing from the scope of the invention.

Figure 5:
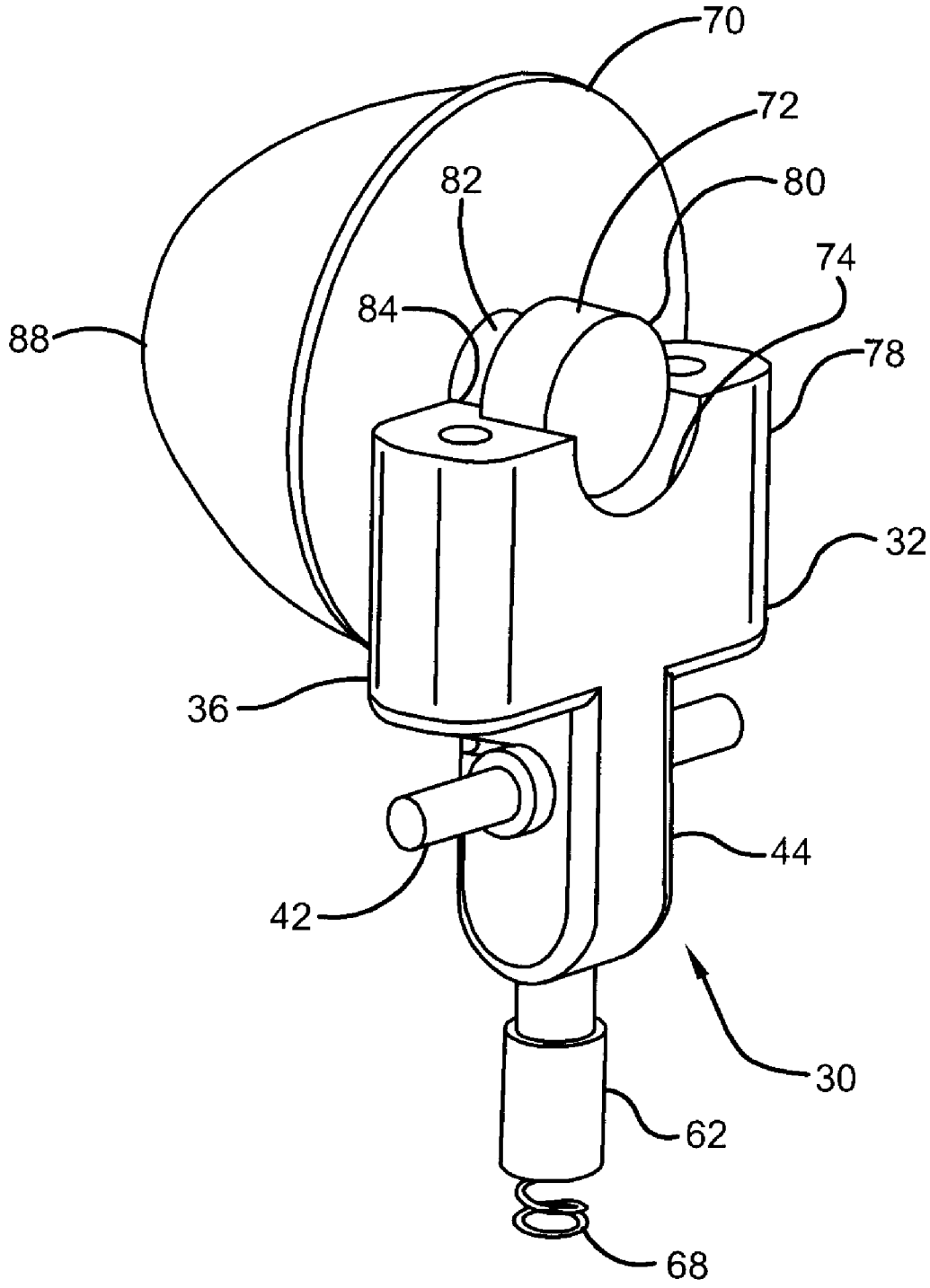
FIG. 5 is a cutaway view of the hinged extension of FIG. 2.

Turning now to FIG. 5, it is seen that the hinged extension 32 has a roller cover mounting cone 70. The roller cover mounting cone 70 has a stub shaft 72 that is rotatably received in a groove 74 in the pivoting body 36. In one embodiment, the pivoting body 36 is made up of an upper body 76 (FIG. 3) and a lower body 78 that come together to form the stub shaft receiving groove 74. The stub shaft 72 has a head portion 80 with a smaller-diameter neck 82 and the groove 74 has a lip 84 formed therein (best seen in FIG. 3) that mates with the neck 82 to prevent the stub shaft mounting cone 70 from being withdrawn from the pivoting body 36. Therefore, once the stub shaft 72 is captured in the groove 74, the mounting cone 70 will pivot with the pivoting body 36. The mounting cone 70 desirably has the bearing surface molded therein to allow rotation of the mounting cone 70 in the groove 74 and is made of a durable ABS or similar material that can withstand wear caused by rotation without significant deterioration. The opposite arm 18 of the frame 12 also has a substantially similar mounting cone (not shown). When the hinged extension 32 is in the roller capture position as shown in FIG. 1, the roller cover 14 is rotatably held on the frame 12 by the two roller mounting cones 70. The apex-portion 88 of the mounting cone 70 is configured to be received in the inner tube 22 of the roller cover 14. The rounded shape of the cone 70 desirably allows consistent, interference-free quick-releasing of the roller cover 14. The rounded shape of the cone 70 also provides a centering action so that when the roller cover 14 is positioned on the mounting cones 70, it will slide into a position for balanced rotation.

To install a roller cover 14 on the frame 12, the hinged extension 32 is positioned to the roller release position such that the pivoting body 36 is pivoted to the outward position by actuating the roller-release button 34. The roller cover 14 is placed on the mounting cone 70 of the non-pivoting arm 18 and the hinged extension 32 is the pivoted so its mounting cone 70 fits into the inner tube 22 of the roller cover 14. Pressure is applied to pivot the hinged extension 32 until the roller cover 14 is pressed onto the two mounting cones 70 and the detention pin 62 slides into the opening 66 in the tongue portion 44 of the pivoting body 36. In one embodiment, the detention pin 62 has a first end 90 that receives the biasing spring 68 and a second end 92 that has a sloped surface. When the roller cover 14 has been released, the detention pin 62 extends from the arm 18, but it will not be engaging the pivoting body 36. When installing the new roller cover 14, the hinged extension 32 is pivoted toward the roller cover 14, and as it is moving back into place, it touches the sloped end 92 of the detention pin 62. This pushes the detention pin 62 down and out of the way until the opening 66 in the pivoting body 36 lines up with the detention pin 62 so that it can move into the opening 66. The sloped end 92 of the detention pin 62 permits the hinged extension 32 to lock into place without having to hold down the quick-release button 34 to pull the pin 62 out of the way.

In one embodiment, the roller cover 14 is received on the cones 70 by a slip fit so that the roller cover 14 can easily slide off the cones 70 when the hinged extension 32 is pivoted to enhance the quick-release feature of the roller 10. The roller cover 14 may freely spin on the cones 70 when the cones are in the roller-capture position such that the roller cover 14 still rotates with respect to the frame 12 in the case dried paint makes it difficult for the cones 70 to spin relative the frame 12. Alternately, the roller cover 14 may be received on the cones 70 with a slight friction fit. The paint roller 10 is ready to use with the roller cover 14 and the mounting cones 70 rotating with respect to the frame 12.

When it is desired to remove the roller cover 14 after use, the operator actuates the roller-release button 34 to draw the detention pin 62 from the tongue portion 44 such that the hinged extension 32, including the pivoting body 36 and its attached mounting cone 70 pivot outward under the force of the torsion springs 56. This causes the mounting cone 70 to be withdrawn from the inner tube 22 of the roller cover 14. The roller cover 14 then freely falls off the mounting cone 70 on the other, non-pivoting arm 18 without the need for the user to come in contact with the wet paint covering the roller cover 14. Therefore, pressing on the roller-release button 34 automatically releases the roller cover 14 from the frame 12. It is conceived that the roller cover 14 could stick to the mounting cone 70 on the non-pivoting arm 18 such that small taps on the roller cover 14 or frame 12 may be necessary to dislodge the roller cover. It is clear that this may be done without having to touch the roller cover 14 with ones hands and does not defeat the quick-release or hands free function of the capture mechanism 30.

Importantly, it is desirable that the roller-release button 34 be a sufficient distance from the roller cover 14 to reduce the likelihood that the actuating surface will become covered with paint. Paint rollers 10 are typically used by dipping the roller cover 14 into a tray filled with the paint to be applied to the work surface. As such, the ends of the arms 18 of the frame 12 also may also come in contact with and be covered by the paint from the tray. Thus, the roller-release button 34 is desirably offset from the axis of the roller cover 14 to position the actuating surface in a location that will not routinely come in contact with the paint. In the embodiment illustrated, the roller-release button 34 is placed on the grip portion 16 of the frame 12 so that the actuator is offset from the axis of the roller by a distance of several inches.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. A paint roller for use with a tube-shaped roller cover, the paint roller comprising:

a Y-shaped roller frame receiving the roller cover such that the roller cover is movable in a rotatable manner with respect to the frame, said roller frame having first and second arms, wherein said first arm comprises a roller capture mechanism moveable between a roller-capture position in which the roller cover is mounted between the first and second arms and a roller-release position in which the roller cover is decoupled from the roller frame, wherein the capture mechanism comprises a hinged extension having a pivoting body at a distal end of the first arm that is movably attached by a pivoting action with a lower branch of the first arm;

a spring that interacts with the lower branch of the first arm and the pivoting body such that the spring biases the hinged extension from its roller-capture position to its roller-release position; and a roller-release button configured to actuate the capture mechanism between its roller-capture position to its roller-release position.

2. The paint roller of claim 1 further comprising a tube-shaped roller cover, wherein the roller cover is a standard 9-inch (23 cm) roller cover.

3. The paint roller of claim 1 wherein the capture mechanism is a quick-release capture mechanism with a hinged portion that pivots outwardly to automatically release the roller cover such that decoupling of the paint roller cover from the roller frame occurs without requiring a user to apply a manual force directly to the roller cover.

4. The paint roller of claim 1 wherein the lower branch of the first arm has forked ends supporting a shaft therebetween and the pivoting body has a tongue portion that mates with the forked ends such that the shaft passes through the tongue portion and forms an axis about which the hinged extension pivots with respect to the lower branch of the first arm.

5. The paint roller of claim 1 wherein the spring is a torsion spring.

6. The paint roller of claim 5 further comprising a detention pin received by the pivoting body so as to maintain the pivoting body, against the bias force of the torsion spring, in its roller-capture position, and a detention pin spring that normally biases the detention pin into the pivoting body.

7. The paint roller of claim 6 wherein the position of the detention pin is controlled by the roller release button for actuating the roller capture mechanism.

8. The paint roller of claim 7 wherein the roller release button is connected to the detention pin with a cable routed through a channel formed in the frame such that actuation of the roller release button causes the detention pin to be withdrawn from an opening in the pivoting body against the bias force of the detention pin spring thereby causing the hinged extension to pivot and release the roller cover.

9. The paint roller of claim 8 wherein the roller release button is positioned in a hand grip of the frame.

10. The paint roller of claim 6 wherein the detention pin has a first end that receives the detention pin spring and a second end having a sloped surface, wherein when the hinged extension is pivoted toward a roller capture position, the pivoting body contacts the sloped end of the detention pin and pushes the detention pin down and out of the way until the opening in the pivoting body lines up with the detention pin so that it can move into the opening so that the hinged extension can be locked into place without having to actuate the roller-release button.

11. The paint roller of claim 1 wherein the hinged extension further comprises a roller cover mounting cone that is rotatably mounted on the hinged body and is configured to be received by the tube-shaped roller cover.

12. The paint roller of claim 11 wherein the roller cover mounting cone has a stub shaft that is rotatably received in a groove in the pivoting body and has a rounded portion that provides a centering action when the roller cover is positioned onto the mounting cone.

13. The paint roller of claim 12 wherein the second arm also comprises a mounting cone at a distal end thereof, and when the hinged extension is moved to its roller capture position, the roller cover is snuggly pressed onto the two mounting cones so that the roller cover rotates with respect to the frame and the detention pin engages the pivoting body.

14. A paint roller comprising:

a tube-shaped roller cover;

a Y-shaped roller frame receiving the roller cover such that the roller cover is movable in a rotatable manner with respect to the frame, said roller frame having first and second arms, wherein said first arm has a quick-release capture mechanism comprising a hinged extension that pivots between a roller-capture position in which the roller cover is rotatably mounted on the roller frame between the first and second arms and a roller-release position in which the roller cover is decoupled from the roller frame such that decoupling of the paint roller cover from the roller frame occurs without requiring a user to apply a manual force directly to the roller cover, wherein said capture mechanism comprises:

a pivoting body;

a roller cover mounting cone that is rotatably mounted on the hinged body and is received by the tube-shaped roller cover;

at least one torsion spring that interacts with a lower branch of the first arm and the pivoting body such that the at least one torsion spring biases the hinged extension from the roller-capture position to the roller-release position;

a detention pin received by the pivoting body so as to maintain the pivoting body, against the bias force of the torsion spring, in its roller-capture position;

a detention pin spring normally biasing the detention pin into engagement with the pivoting body; and a roller-release button on the roller frame configured to actuate the detention pin so as to control movement of the capture mechanism between the roller-capture position to the roller-release position.

15. The paint roller of claim 14 wherein the capture mechanism comprises a hinged extension having a pivoting body at a distal end of the first arm that is movably attached by a pivoting action with a lower branch of the first arm, wherein the lower branch of the first arm has forked ends that supports a shaft therebetween and the pivoting body has a tongue portion that mates with the forked ends such that the shaft passes through the tongue portion and forms an axis about which the hinged extension pivots with respect to the lower branch of the first arm.

16. The paint roller of claim 15 wherein the roller release button is connected to the detention pin with a cable routed through a channel formed in the frame such that actuation of the roller release button causes the detention pin to be withdrawn from the opening in the pivoting body against the force of the detention pin spring to allow the hinged extension to pivot and release the roller cover.

17. The paint roller of claim 16 wherein the second arm also comprises a mounting cone at a distal end thereof, and when pressure is applied to pivot the hinged extension the roller cover is snuggly pressed onto the two mounting cones and the detention pin slides into the opening in the pivoting body so that the roller cover rotates with respect to the frame.

18. A paint roller frame for use with a conventional tube-shaped roller cover, the paint roller frame comprising:

a Y-shaped roller frame receiving the roller cover such that the roller cover is movable in a rotatable manner with respect to the frame, said roller frame having first and second arms, wherein said first arm has a quick-release capture mechanism comprising a hinged extension that pivots between a roller-capture position in which the roller cover is rotatably mounted on the roller frame between the first and second arms, and a roller-release position in which the roller cover is decoupled from the roller frame such that decoupling of the paint roller cover from the roller frame occurs without requiring a user to apply a manual force directly to the roller cover, wherein said capture mechanism comprises: a pivoting body;

a roller cover mounting cone that is rotatably mounted on the pivoting body and is received in an open end of the tube-shaped roller cover;

at least one torsion spring that interacts with a lower branch of the first arm and the pivoting body of the hinged extension such that the at least one torsion spring biases the hinged extension from the roller-capture position to the roller-release position;

a detention pin engaging the pivoting body so as to maintain the hinged extension, against the bias force of the at least one torsion spring, in its roller-capture position;

a detention pin spring normally biasing the detention pin into engagement with the pivoting body; and a roller-release button on the roller frame configured to actuate the detention pin so as to control movement of the hinged extension between its roller-capture position to its roller-release position.

* * * * *